US006811143B2

(12) United States Patent
Creissel et al.

(10) Patent No.: US 6,811,143 B2
(45) Date of Patent: Nov. 2, 2004

(54) VALVE SPRING ASSEMBLY AND INSTALLATION METHOD

(75) Inventors: Julie Creissel, Chatenay-Malabry (FR); Max Paty, Neuville aux Bois (FR)

(73) Assignee: Deere & Company, Moline, IL (US)

( * ) Notice: Subject to any disclaimer, the term of this patent is extended or adjusted under 35 U.S.C. 154(b) by 126 days.

(21) Appl. No.: 10/217,845

(22) Filed: Aug. 13, 2002

(65) Prior Publication Data

US 2003/0038269 A1 Feb. 27, 2003

(30) Foreign Application Priority Data

Aug. 25, 2001 (DE) ..... 101 41 782

(51) Int. Cl.[7] ..... F01L 1/46
(52) U.S. Cl. ..... 251/337; 123/90.65
(58) Field of Search ..... 251/337, 336; 123/90.65, 90.67, 90.61; 403/326; 24/324

(56) References Cited

U.S. PATENT DOCUMENTS

| | | | | | |
|---|---|---|---|---|---|
| 1,537,555 | A | * | 5/1925 | Schenk | 251/337 |
| 1,638,251 | A | * | 8/1927 | Fisher | 251/337 |
| 2,171,668 | A | * | 9/1939 | Oldham | 251/337 |
| 2,759,466 | A | | 8/1956 | Heimbuch | 123/90 |
| 2,855,915 | A | | 10/1958 | Norton | 123/188 |
| 3,033,518 | A | * | 5/1962 | Sampietro | 251/337 |
| 3,612,016 | A | * | 10/1971 | Jelen | 123/90.67 |
| 3,815,873 | A | * | 6/1974 | Hendrick | 251/337 |
| 4,509,473 | A | * | 4/1985 | Hamparian | 251/337 |
| 4,538,563 | A | * | 9/1985 | Mayers | 123/90.67 |
| 4,653,721 | A | * | 3/1987 | Bachmann et al. | 403/326 |
| 5,259,096 | A | * | 11/1993 | Grant | 24/324 |
| 5,515,821 | A | | 5/1996 | Wolck, Jr. | 123/90.37 |
| 5,606,940 | A | * | 3/1997 | Shafer et al. | 251/337 |
| 5,829,906 | A | * | 11/1998 | Gabas Cebollero | 403/326 |

FOREIGN PATENT DOCUMENTS

| | | |
|---|---|---|
| DE | 44 21 408 A | 12/1995 |
| EP | 0 387 922 | 9/1990 |
| FR | 999 650 | 2/1952 |
| GB | 595 696 | 12/1947 |
| GB | 629 192 | 9/1949 |
| GB | 665 435 | 1/1952 |

* cited by examiner

*Primary Examiner*—J. Casimer Jacyna

(57) ABSTRACT

A valve spring assembly includes a hollow valve spring plate and a locking element retained by a retainer both received in the interior of the hollow valve spring plate. The locking element is removable from the valve spring plate while the retainer is received by the valve spring plate.

12 Claims, 3 Drawing Sheets

VALVE SPRING ASSEMBLY AND INSTALLATION METHOD

BACKGROUND OF THE INVENTION

The present invention relates to a valve spring assembly.

Known valve spring assemblies include a valve spring plate which can be mounted to a valve stem and which supports a valve spring. The valve spring plate is retained on the valve stem by means of locking means, such as clamping cones or retaining rings, etc. Such valve spring assemblies, valve spring plates and installation methods are used in the manufacture of drives, machines or vehicles.

German patent 44 21 408 shows a valve spring assembly with a hollow valve spring plate and a valve spring that engages a rim region of the valve spring plate, which can be attached to the stem of a valve of an internal combustion engine. In order to secure the valve spring plate to the valve stem, the valve spring assembly is provided with a locking element that is formed by clamping cone halves. Retaining projections or brackets are provided on the valve spring plate to secure the locking element in an inner region of the valve spring plate against loss.

SUMMARY

Accordingly, an object of this invention is to provide a valve spring assembly which can be easily installed.

These and other objects are achieved by the present invention, wherein a valve spring assembly includes a hollow or sleeve-like valve spring plate and a locking element retained by a retainer. The valve spring plate and the retainer form a pre-assembled unit. These components can be installed in a single assembly cycle or together on a valve stem and just as simply removed from it again. It is not necessary to install the valve spring plate first, then to attach the locking element and then to secure these to the valve stem, for example, by a positive locking, connection or a non-positive locking connection. Instead, the valve spring assembly is installed on the valve stem and conducted along it until the locking element makes a locking connection with the valve stem. The valve spring plate is secured to the valve stem and is loaded by a valve spring. The valve spring plate is moved towards the locking element and can be secured by the locking element on the valve stem in the axial direction. In order to disassemble the valve spring assembly or the valve spring plate, the plate can be loaded against the force of the valve spring so that the locking element exits from the sleeve and thereby becomes accessible for the disassembly, for example, with the use of tools, such as a screwdriver.

The retainer may comprise a hinge and/or a spring which can fold over as a function of the load applied to it, so that the locking element can be withdrawn from the valve spring plate. Preferably, at least a portion of the retainer comprises an elastic component, such as a simple and low cost elastic plastic element or rubber element.

The retainer may be a removable component which may be clamped to the valve spring plate or otherwise secured. The retainer can be formed onto the valve spring plate, such as in the form of an elastic sheet metal component. Alternatively, the retainer may be permanently connected to the plate by adhesive, or welding, or the like. The retainer may be a one-piece component or a multi-piece unit. Preferably, it has an inwardly projecting lip clamped in a groove formed in an inner surface of the plate.

Preferably, the valve spring plate has a contact surface which engages the locking element to prevent axial movement of the valve spring plate in one direction. Preferably, the contact area is formed by a shoulder on the plate. The shoulder may be a gradual or abrupt transition.

The valve spring plate may not interact directly with the valve spring, but instead with further components arranged between the valve spring and the valve spring plate. However, the valve spring plate includes a contact area for the valve spring. The contact area is preferably arranged in a rim region of the valve spring plate, or is formed by it, since the valve spring is usually configured as a helical spring through which a valve stem can extend.

Preferably, the valve spring plate includes means for securing the valve spring, so that the valve spring is integrated into the valve spring assembly in such a way that it can be installed together with the valve spring plate and the locking means. Preferably, the plate has a hook-shaped rim which surrounds an opening which receives the valve spring, so that the plate engages and is clamped to an end of the valve spring plate. Alternatively, the spring may be non-removably coupled to the plate, such as by welding, soldering or the like. The spring may also be retained by a simple and cost effective conventional retaining ring, or by retaining disks or snap rings or by corresponding components that preferably interact with an encircling groove in the valve stem.

Preferably, the valve spring assembly includes a valve stem seal which is removably fastened to the valve spring plate so that the valve stem seal can be installed together with the valve spring assembly. Later, it can be separated from the valve spring plate and placed in an operating position.

The valve spring plate includes a recess which releasably receives the valve stem seal. Alternatively, the valve spring plate may have a projection which is releasably received by a recess formed in the valve stem seal. The recess is designed so that the valve stem seal is released when it has reached its operating position on the cylinder head, wherein the valve stem seal is secured on the cylinder head by a clamped connection, by friction locking, or in other ways.

The valve spring plate may be a single individual part and can be combined with the remaining components of the valve spring assembly in a pre-assembly station and then applied together with these other components as an installation unit on a valve stem of an internal combustion engine.

The valve spring assembly may be manually or automatically installed. By combining several components in a valve spring assembly which can be brought to an installation site, the installation process can be accelerated or performed by means of a robot, for example, with a magazine or an automated supply arrangement.

DETAILED DESCRIPTION

Figure 1:
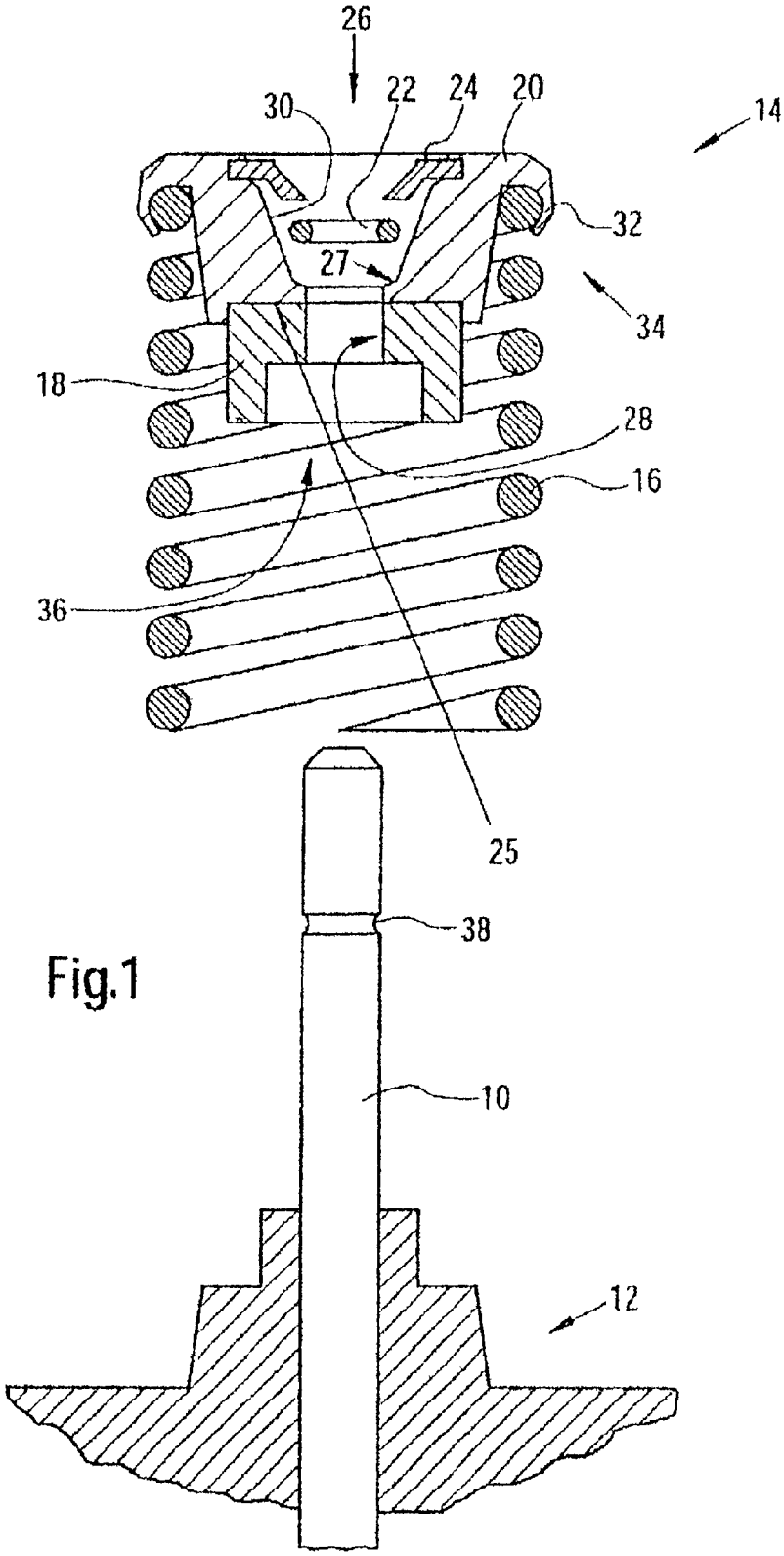
FIG. 1 is a partial sectional view of a valve spring assembly with a valve stem extending through a cylinder head of an internal combustion engine.

Referring to FIG. 1, a valve stem 10 of an intake or exhaust valve (not shown in any further detail), extends through a portion of the cylinder head 12 of an internal combustion engine (not shown). Above the valve stem 10 a valve spring assembly 14 is shown as removed from or not installed on the valve stem 10.

The valve spring assembly 14 includes a valve spring 16, a valve stem seal 18, a valve spring plate 20, a locking element or locking ring 22, as well as an elastic retainer 24. The retainer 24 is a hollow annular member and surrounds a bore or opening which extends completely through retainer 24. The valve spring 16 in the installed condition is brought into contact at one end with the cylinder head 12 and at the other end with an underside 25 of the valve spring plate 20.

The valve spring plate or sleeve 20 is a collar-shaped, rotationally symmetrical shaped component, and has a central, approximately circular recess 26. Recess 26 has a diameter, in the region 28 facing the valve stem 10, which provides a sliding fit with the valve stem 10. Region 30 of recess 26 has a diameter which is greater than the first diameter, thereby forming a shoulder or a contact surface 27 therebetween. The diameter of recess 26 preferably increases with increasing distance from the contact surface 27.

An outer rim 32 of the valve spring plate 20 engages and supports the valve spring 16 on the valve spring plate 20, and has a hook-shaped cross-section which surrounds an annular opening which faces downwardly towards bottom surface 25 of the valve spring plate 20. An end 34 of the valve spring 16 engages the rim 32 and is clamped on the valve spring plate 20.

A recess 36 or circular depression is formed in the bottom surface 25 of valve spring plate 20. The recess 36 has a diameter so that there can be a releasable clamped connection between the recess 26 and the valve stem seal 18. Preferably, the valve stem seal 18 is made from an elastic material or an elastic plastic material so that it performs a desired sealing function.

The valve stem 10 and the cylinder head 12 are configured in the usual manner, where the valve stem 10 includes an encircling groove 38 in an upper region facing away from the cylinder head 12.

A method for installing the valve spring assembly on the valve stem 10 is as described in connection with FIGS. 2 through 5.

Figure 2:
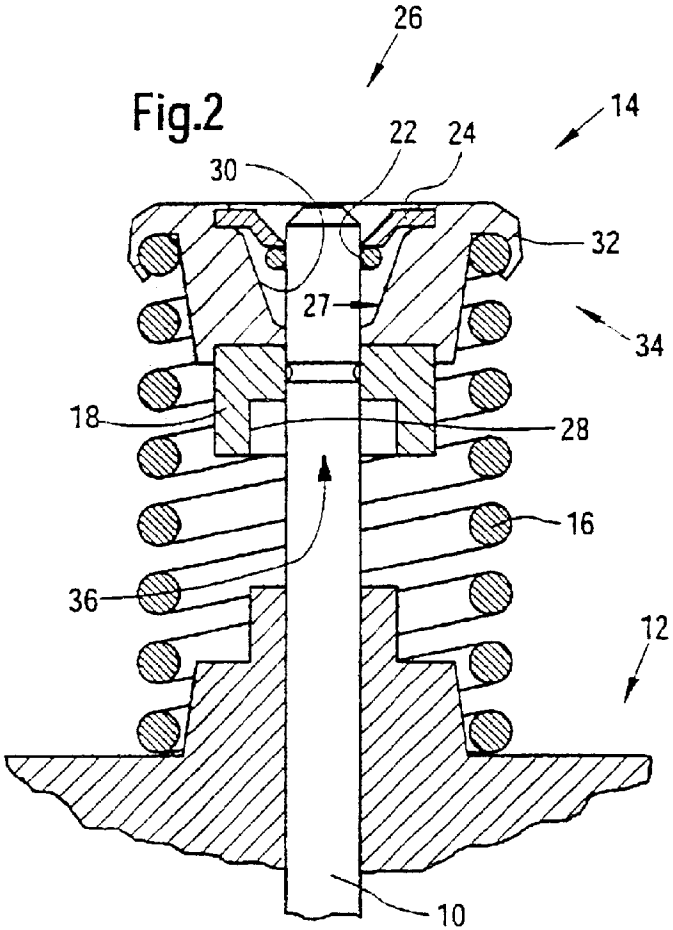

Referring now to FIG. 2, the valve spring assembly 14 has been applied to the valve stem 10, so that the valve spring 16 is brought into contact with the cylinder head 12, where no further force is applied. In this first position the locking element 22 is located above the groove 38, it is arranged within the sleeve-shaped valve spring plate 20.

Figure 3:
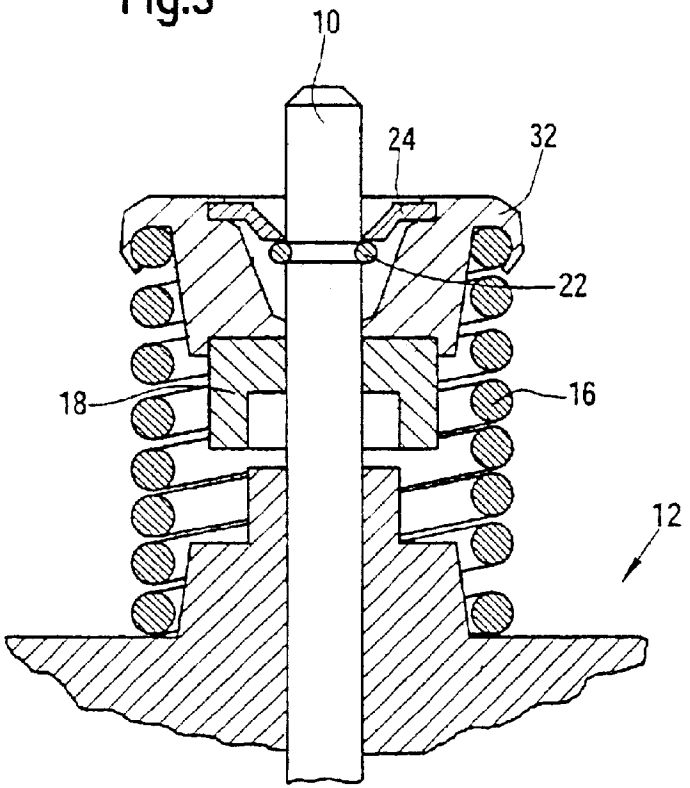
FIGS. 2–5 are partial sectional views of the valve spring assembly of FIG. 1, showing individual stages during installation of the valve spring assembly on the valve stem.

Referring now to FIG. 3, the valve spring plate 20 is moved towards the cylinder head 12 against the force of the valve spring 16. The locking element 22 also moves downward since it is carried along by the retainer 24.

If the valve spring 16 is compressed in such a way that the locking element 22 is brought to the groove 38 of the valve stem 10, then the locking element 22 is brought into engagement with the groove 38 upon a further movement of the valve spring plate 20 in the direction of the cylinder head 12. The locking element 22 is preferably configured in the form of a retaining ring or a spring ring. This engagement generates an audible click that, in the case of a manual installation, can indicate to an operator that the locking element 22 has been brought into position. In order to move the valve spring plate 20 further, a force must now be applied which is sufficient to deflect the elastic retainer 24 so that the locking element 22 can be moved past it without being brought out of engagement with the groove 38. This further movement of the valve spring plate 20 is performed in order to move the valve stem seal 18 further towards the cylinder head 12 so that it can clampingly engage a correspondingly portion of the cylinder head 12.

Figure 5:
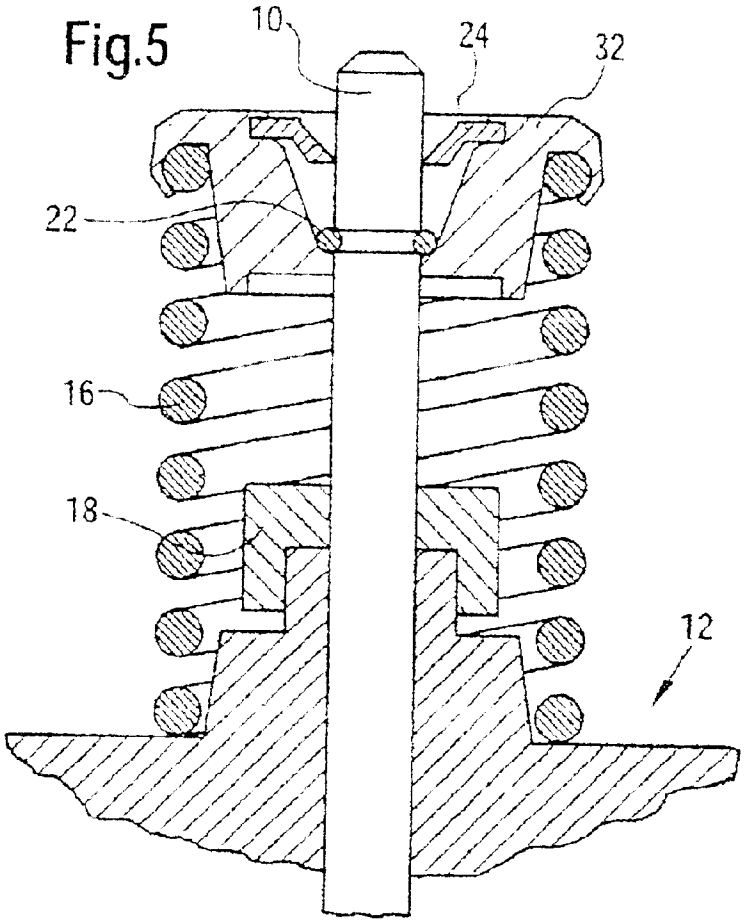
Figure 4:
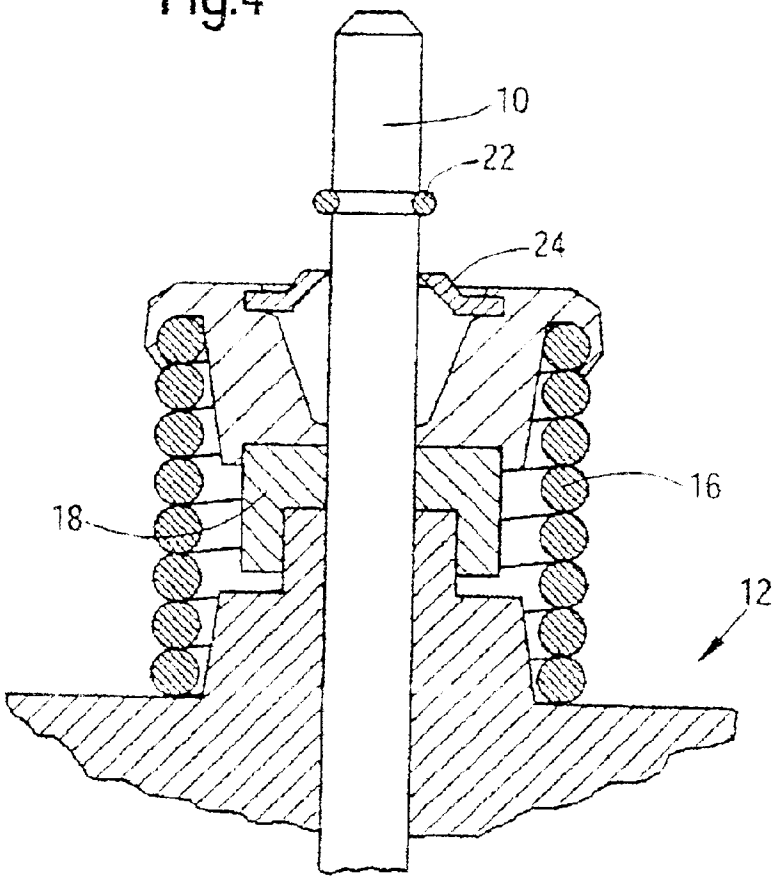

Referring now to FIG. 5, the valve stem seal 18 remains engaged with the cylinder head 12 after the valve spring plate 20 has moved away from the cylinder head 12. The valve spring assembly 14 is now in its operating position wherein the valve spring plate 20 is released form valve stem seal 18. If the valve spring 16 urges the valve spring plate 20 away from the cylinder head 12, then the locking means 24 is again moved into contact with the locking element 22. The valve spring 16 and the retainer 24 are preferably dimensioned to assure that the retainer 24 deflects and allows the locking element 22 to move past it and enter into the interior region of the plate 20. The valve spring 16 moves the valve spring plate 20 on the valve stem 10 contact surface 27 of the valve spring plate 20 engages the locking element 22. Further expansion of the valve spring 16 would result in movement of the valve stem 10 relative to cylinder head 12, and the valve spring assembly 14 is ready for operation.

To un-install the valve spring assembly 14 from the valve stem 10, the valve spring plate 20 is moved against the force of the valve spring 16 and towards the cylinder head 12, until the locking element 22 is removed from the valve spring plate 20. The locking element 22 is now accessible and can be removed easily from the valve stem 10, for example, with the use of a screwdriver or another appropriate tool. Now, the valve spring assembly 14 and, in particular, the valve stem seal 18 can be taken off or removed from the valve stem 10 or the cylinder head 12.

The process described above can be performed manually. But it could also be performed automatically, since the valve spring assembly 14 includes in a pre-assembled unit all components that are to be attached to the valve stem 10.

While the present invention has been described in conjunction with a specific embodiment, it is understood that many alternatives, modifications and variations will be apparent to those skilled in the art in light of the foregoing description. Accordingly, this invention is intended to embrace all such alternatives, modifications and variations which fall within the spirit and scope of the appended claims.

We claim:

1. A valve spring assembly for mounting on a valve stem, the assembly having a hollow valve spring plate and a locking element, the locking element being retained by a retainer in an interior of the valve spring plate, wherein:

the locking element can be removed from the interior of the valve spring plate against the force of the retainer, and the locking element interacts with the valve spring plate to limit axial movement of the valve spring plate on the valve stem in one direction, the locking element and the retainer being received by the valve spring plate, the locking element being removable from the interior of the valve spring plate while the retainer is received by the valve spring plate.

2. The valve spring assembly of claim 1, wherein:

a portion of the retainer is formed out of an elastic material.

3. The valve spring assembly of claim 1, wherein:

the retainer is supported by the valve spring plate.

4. The valve spring assembly of claim 1, wherein:

the retainer includes an inwardly projecting lip.

5. The valve spring assembly of claim 1, wherein:

the valve spring plate has an inner contact surface which can interact with the locking element.

6. The valve spring assembly of claim 1, wherein:

the valve spring plate has a rim which supports a valve spring.

7. The valve spring assembly of claim 6, wherein:

the rim has a hook-shaped cross section and surrounds an opening which opens towards the valve spring.

8. The valve spring assembly of claim 1, wherein:

the locking element comprises a retaining ring which is receivable by an annular groove in the valve stem.

9. The valve spring assembly of claim 1, further comprising:

a valve stem seal which is removably retained by the valve spring plate.

10. The valve spring assembly of claim 9, wherein:

the valve spring plate has a bottom surface which is releasably engageable with the valve stem seal.

11. The valve spring assembly of claim 1, wherein:

the valve stem and the locking element are movable against a bias of the retainer through and out of the valve spring plate.

12. The valve spring assembly of claim 11, wherein:

the valve stem extends through an opening in the cylinder head; and the valve spring plate is releasable coupled to a valve stem seal, the valve stem seal being engagable with a portion of a cylinder head as the valve spring plate moves along the valve stem so that the valve stem seal is released from the valve spring plate to seal the opening in the cylinder head.

* * * * *